US005647807A

United States Patent [19]

Nagamoto

[11] Patent Number: 5,647,807

[45] Date of Patent: Jul. 15, 1997

[54] GOLF CLUB

[75] Inventor: Itsushi Nagamoto, Hamamatsu, Japan

[73] Assignee: Yamaha Corporation, Shizuoka, Japan

[21] Appl. No.: 616,703

[22] Filed: Mar. 15, 1996

[30] Foreign Application Priority Data

Apr. 3, 1995 [JP] Japan ..... 7-099490

[51] Int. Cl.[6] ..... A63B 53/02

[52] U.S. Cl. ..... 473/305; 473/318

[58] Field of Search ..... 473/305–315, 473/324, 282, 287, 289, 226, 316, 318

[56] References Cited

U.S. PATENT DOCUMENTS

| | | | |
|---|---|---|---|
| 796,802 | 8/1905 | Brown | 473/307 |
| 1,695,291 | 12/1928 | Muller | 473/308 |
| 1,829,900 | 11/1931 | Johnson | 473/312 |
| 5,324,033 | 6/1994 | Fenton | 473/305 |

FOREIGN PATENT DOCUMENTS

| | | | |
|---|---|---|---|
| 320258 | 10/1929 | United Kingdom | 273/80.2 |
| 332354 | 7/1930 | United Kingdom | 273/80.3 |
| 350568 | 6/1931 | United Kingdom | 273/80.3 |
| 371974 | 5/1932 | United Kingdom | 273/167 F |
| 412662 | 7/1934 | United Kingdom | 273/80.5 |

*Primary Examiner*—Sebastiano Passaniti
*Attorney, Agent, or Firm*—Koda and Androlia

[57] ABSTRACT

A golf club with one or more annular grooves formed on the outer circumferential surface of the hosel portion of the head, the hosel portion being provided with an outwardly widened tapered surface on the inner circumferential surface of the opening end of a shaft insertion hole of the hosel portion, thus preventing brakeage of the shaft by way of the groove(s) and the tapered surface. The grooves can be filled with non-rigid cosmetic members for a better appearance.

15 Claims, 3 Drawing Sheets

GOLF CLUB

BACKGROUND OF THE INVENTION

1. Field of the Invention

The present invention relates to a golf club, such as an iron and a wood, and more particularly to an improvement in the hosel portion of a head of a golf club where a tip end of a shaft is connected.

2. Prior Art

In a golf club, as shown in FIG. 5, the tip end portion 10*a* of the shaft 10, which is substantially a tapered tube, is fastened in place by a bonding agent, etc. inside a shaft insertion hole 3 formed in the hosel portion 2 (called "hosel") of the head 1, thus connecting the head 1 to the shaft 10. One type of golf club, as seen from this FIG. 5, is provided with a tapered surface 4 on the inner circumferential surface of the opening end 3a of the shaft insertion hole 3 of the hosel 2. The tapered surface 4 opens outwardly and is chamfered at an angle θ of 20 to 45 degrees.

This tapered surface 4 is formed so as to alleviate the local concentration of stress in the shaft 10 which is derived from the impact at the time of hitting the ball, thus preventing breakage of the shaft.

However, this type of golf club has a problem. Though the tapered surface 4 is employed as a countermeasure against breakage of the shaft 10, it still cannot provide a sufficiently reliable anti-breakage effect, and damages to the club have occurred occasionally.

SUMMARY OF THE INVENTION

Accordingly, the object of the present invention is to provide a golf club in which the structure of the hosel portion (called "hosel") of the head is modified so that the local concentration of stress in the tip end portion of the shaft caused by the impact that occurs when the ball is hit is alleviated, thus assuredly preventing breakage of the shaft.

It is another object of the present invention to provide a golf club which is free from breakage of the shaft with an improved external appearance in the head.

It is a further object of the present invention to provide a golf club that has a lower center of gravity and a widened sweet spot which are achieved as a result of a reduction in the weight of the hosel.

The above and other objects of the present invention are accomplished by a unique and improved structure for a golf club which has an outwardly tapered surface chamfered on the inside circumferential surface of the opening end of the shaft insertion hole of the hosel of the head into which the shaft is inserted, and the unique structure of the present invention is that an annular groove (preferably two to four annular grooves) are formed in the outer circumferential surface of the tip end area of the hosel of the head. This structure can be applied to a golf club which has a head with no outwardly tapered surface on the inside circumferential surface of the opening end of the shaft insertion hole of the hosel into which the shaft is inserted.

In this structure, when two or more annular grooves are provided, the depth, width and/or pitch of these annular grooves can be differentiated from groove to groove. In other words, the depth, width and/or pitch of the grooves can be either uniform or gradually varied, so that the bending rigidity of the hosel can be lowered.

In addition, the angular grooves can be filled with non-rigid cosmetic members made of plastic, celluloid, etc.

With the structure described above, since one or a plurality of annular grooves are formed in the outer circumference of the tip end area of the hosel which is typically provided with an outwardly expanding tapered surface at the opening end of the shaft insertion hole, the tip end area of the hosel has a flexibility which can allow the hosel tip end area to conform to the "flexing" of the shaft when the ball is hit. Furthermore, the local concentration of stress in the shaft is alleviated by a synergistic effect produced by this flexibility and the tapered surface; thus, the breakage of the shaft can be reliably prevented.

In addition, the weight of the hosel is reduced because of the formation of the annular grooves. Accordingly, when a golf club head that has the same overall weight as a conventional head is used in the present invention, the amount of the weight by which the hosel is lightened can be distributed around the periphery of the head; and as a result, the position of the center of gravity of the head (in other words, the sweet spot) can be lowered and also shifted toward the toe area from the locations of those in the conventional golf clubs. Thus, a wide spot can be secured as a result of the lowering of the center of gravity and the widening of the sweet spot.

Furthermore, the depth, width and pitch (or one or two of these elements) of the respective annular grooves can be set as a uniform dimension or can be varied gradually, thus lowering the bending rigidity of the tip end area of the hosel. Accordingly, a flexibility in the hosel which is suited to the bending rigidity of the shaft and to the strength and/or preference of the user can easily be obtained.

Still further, the external appearance of the club can be enhanced when the respective grooves are filled with cosmetic members made of a non-rigid material such as plastic, celluloid, etc.

DETAILED DESCRIPTION OF THE PREFERRED EMBODIMENTS

Figure 5:
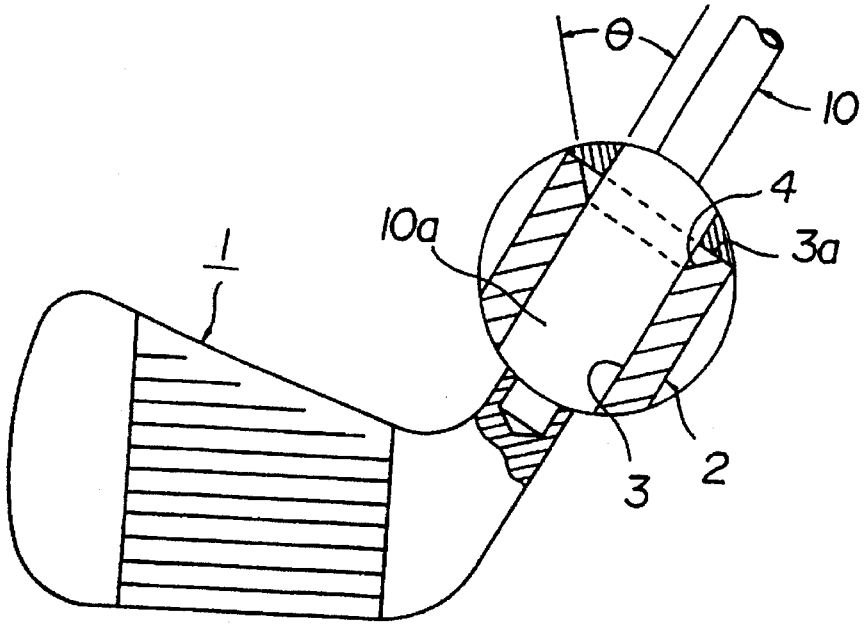
FIG. 5 PRIOR ART
FIG. 5 is an explanatory diagram showing a partially enlarged sectional view of a conventional golf club.

One embodiment of the present invention will be described in detail with reference to FIGS. 1 through 3. In the embodiment of the present invention, parts that have the same constitution as those in the conventional golf club illustrated in FIG. 5 will be described using the same reference numerals. In addition, the embodiments are described and illustrated for an iron club, but the invention is applicable for a wood and a metal-wood club also.

Figure 1:
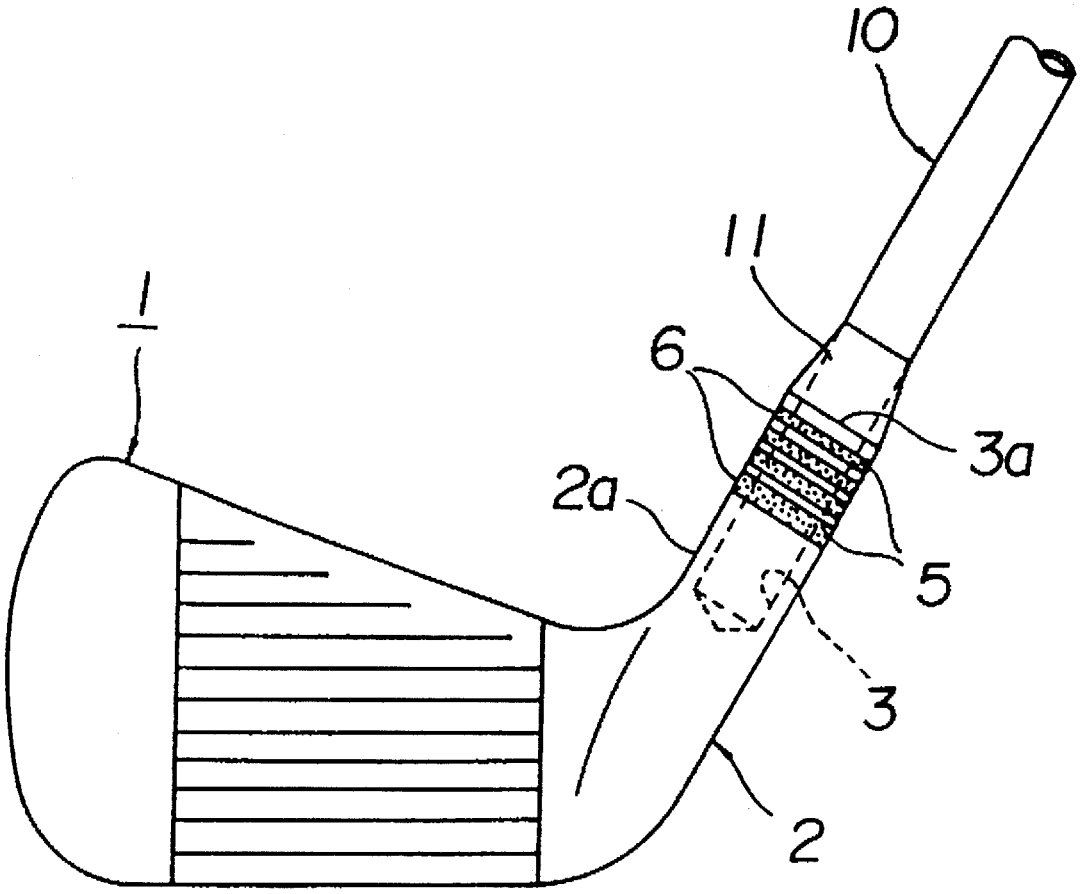
FIG. 1 is an explanatory diagram which illustrates one embodiment of the golf club according to the present invention.
Figure 2:
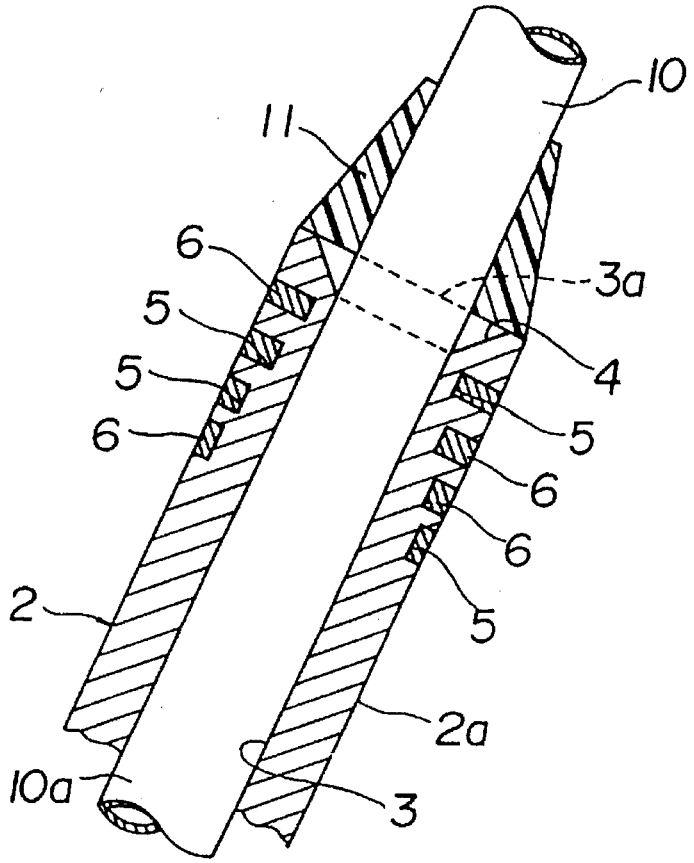
FIG. 2 is an enlarged vertical sectional view of the essential area of the hosel thereof.

As shown in FIGS. 1 and 2, the golf club head 1 (called "head") of the golf club of the present invention includes a hosel portion 2 (called "hosel") which is formed into an integral unit with the head 1 by casting or forging using a metal material such as soft iron, carbon steel (Be-Cu), stainless steel (SuS), aluminum bronze, etc.

The hosel 2 of the head 1 is provided with a shaft insertion hole 3 so that the tip end portion 10*a* of the golf club shaft 10 is inserted into the hole 3. A bonding agent is interposed between the inner surface of the hole 3 and the outer surface of the tip end portion 10a of the shaft 10 so that the head 1 is securely connected to the shaft 10. Typically, the hosel 2 or its shaft insertion hole 3 is formed with a tapered surface 4 on the inside circumferential surface of the opening end 3*a* of the shaft insertion hole 3. The tapered surface 4 is shaped so as to become gradually wider toward the outside so that the opening angle θ is approximately 20 to 45 degrees.

In addition, the hosel 2 is provided with an annular groove 5 circumferentially formed on its exterior surface. More specifically, a plurality of annular grooves 5 (typically, four grooves as illustrated in FIG. 2) are formed at an appropriate pitch in the outer circumferential surface 2*a* of the tip end area of the hosel 2. These grooves 5 are formed by cutting-out a portion or portions of the hosel 2 circumferentially or during the molding process. Each one of the grooves 5 has a quadrilateral cross section as best seen from FIG. 2; but the cross section of the groove can be aother shape such as a semicircle.

Typically, these annular grooves 5 are formed parallel to each other and to a plane that is perpendicular to the axis of the shaft insertion hole 3 of the hosel 2.

The grooves 5 can be filled with non-rigid cosmetic members 6 which are made of plastic, celluloid, etc. Preferably, the cosmetic members 6 are colored differently. In addition, a ferrule (which is a protective member) 11 is installed at the joint area between the hosel 2 and shaft 10.

Figure 3:
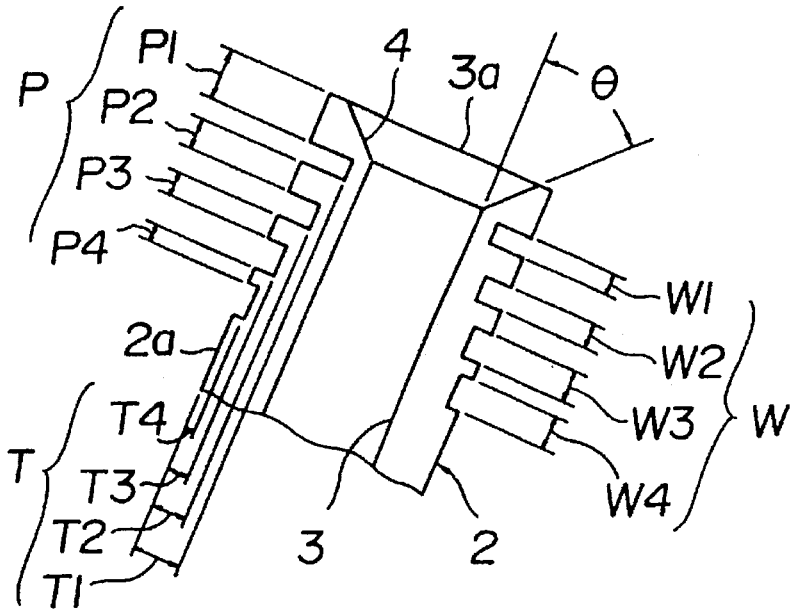
FIG. 3 is an explanatory diagram which illustrates the format of the cutout grooves in the hosel of the embodiment.

As shown in FIG. 3, the depth dimension T can be varied so that the depth of the grooves 5 gradually becomes deeper toward the tip end of the hosel 2 (T1>T2>T3>T4). The width dimension W of the groove also can be varied so that the width W of the grooves 5 gradually becomes narrower toward the tip end of the hosel 2 (W1<W2<W3<W4). Furthermore, the pitch dimension P can be varied so that the pitch, which is the length between the grooves, gradually becomes wider toward the tip end of the hosel 2 (P1>P2>P3>P4). In this way, the bending rigidity of the tip end area of the hosel 2 can be adjusted and lowered.

The dimensions of the depth T, width W and pitch P of the grooves 5 can be uniform for all the grooves 5 (T1=T2=T3=T4; W1=W2=W3=W4; P1=P2=P3=P4). They can be in the reverse order from those described above (T1<T2<T3<T4; W1>W2>W3>W4; P1<P2<P3<P4). In addition, they need not be varied in a gradual fashion; for instance, for the dimension of the pitch P, P1 can be larger than P2 but P3 is smaller than P4.

In the above embodiment, the head 1 and the hosel 2 are formed integrally; however, the present invention is applicable to a golf club that has a head which is a separate piece from the hosel. In other words, it is possible to apply the present invention to a golf club in which a head I having a metal outer shell structure made of, for example, soft iron, carbon steel (Be-Cu), stainless steel (SuS), aluminum bronze, is connected to a separate hosel 2 made of a material with a low specific gravity and a high strength such as titanium (Ti), a titanium alloy, an aluminum alloy or a fiber-reinforced plastic (FRP), which is different from the material used to form the head 1.

In this case, since the head 1 and the hosel 2 are separate parts, the hosel 2 can be removed for replacement. Accordingly, it is possible for a user to select a hosel that has a preferred performance and external appearance. Furthermore, if the hosel 2 is made of a material with a low rigidity such as titanium and aluminum, the alleviation of stress concentration in the shaft 10 is greatly aided. Moreover, there is no need in this case to use a protective member such as a ferrule, etc., as is required in a conventional club. Accordingly, a reduction in manufacturing cost can also be achieved.

Figure 4:
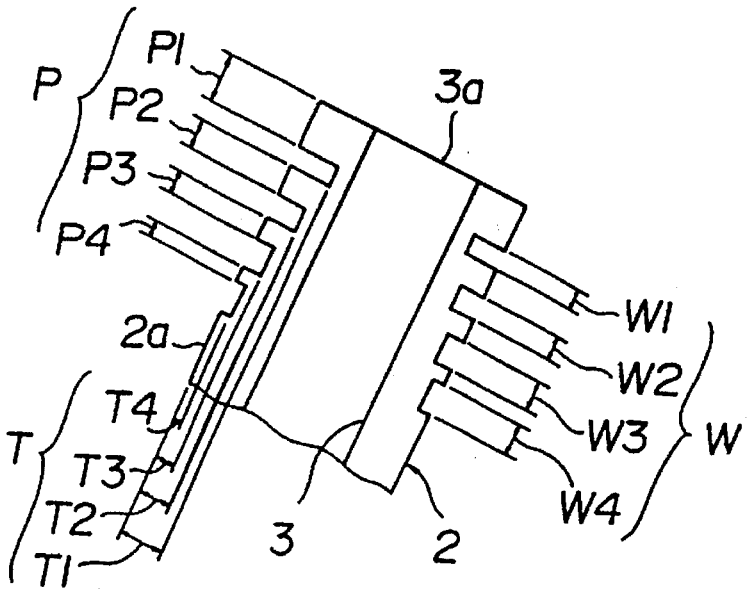
FIG. 4 is an explanatory diagram which shows another embodiment of the present invention having no tapered surface inside the shaft insertion hole of the hosel.

In addition, the present invention is applicable to a head that has no outwardly tapered surface on the inside circumferential surface of the opening end of the shaft insertion hole as shown in FIG. 4.

As seen from the above, according to the present invention, one or a plurality of annular grooves are formed in the outer circumferential surface of the tip end area of the hosel of the head which has an outwardly expanding tapered surface chamfered on the inside circumferential surface of the opening end of the shaft insertion hole. Accordingly, the tip end area of the hosel has a flexibility which allows the tip end area of the hosel to conform to the "flexing" of the shaft when the ball is hit. Furthermore, the local concentration of stress in the shaft is alleviated by a synergistic effect produced by this flexibility and the tapered surface, so that breakage of the shaft is reliably prevented.

In addition, the weight of the hosel is reduced as a result of the formation of the cut-out grooves. Accordingly, when a head that has an overall weight equal to a conventional head is used, the amount of weight by which the hosel is lightened can be distributed around the periphery of the head, so that the position of the center of gravity of the head (or the sweet spot) can be lowered and shifted toward the toe area from the position where the center of gravity is located in a conventional golf club head. Thus, a wide spot can be obtained as a result of the lowering of the center of gravity and a widening of the sweet spot in the head.

Furthermore, the depth, width and/or pitch of the respective grooves is either set as a uniform dimension or for varied dimensions so the bending rigidity of the tip end area of the hosel can meet the preference of a user. Accordingly, a flexibility in the hosel which is suited to the bending rigidity of the shaft and to the physical strength or preference of the user, can easily be obtained.

In addition, the external appearance of the club can be enhanced when the respective grooves are filled with cosmetic members made of a non-rigid material such as plastic, celluloid, etc.

I claim:

1. A golf club comprising a shaft and a head attached to said shaft and in which a tapered surface that opens outward is chamfered in an inside circumferential surface of an opening end of a shaft insertion hole formed in a hosel portion of said head so that a tip end portion of said shaft is inserted into said shaft insertion hole, said golf club being characterized in that a plurality of separate annular grooves are formed in an outer circumferential surface of a tip end area of said hosel portion and a size of each of said plurality of separate annular grooves varies so that a bending rigidity of said tip end area of said hosel portion can be lowered.

2. A golf club according to claim 1, characterized in that a depth or width of said annular grooves is gradually varied to vary said size of said annular grooves.

3. A golf club according to claim 1, characterized in that said annular groove is filled with a non-rigid cosmetic member.

4. A golf club according to claim 2, characterized in that said annular grooves are filled with non-rigid cosmetic members.

5. A golf club comprising a shaft and a head attached to one end of said shafts, said head having a hosel portion which has a shaft insertion hole and a tapered surface on an inside circumferential surface of an opening end of said shaft insertion hole, wherein said hosel portion is provided with a plurality of separate annular grooves on an outer circumferential surface thereof and a size of each of said plurality of separate annular grooves varies so that a bending rigidity of said tip end area of said hosel portion can be lowered.

6. A golf club comprising a shaft and a head attached to one end of said shaft, said head having a hosel portion which has a shaft insertion hole and a tapered surface on an inside circumferential surface of an opening end of said shaft insertion hole, wherein said hosel portion is provided with a plurality of separate annular grooves on an outer circumferential surface thereof, said annular grooves being parallel to a plane which is perpendicular to an axis of said shaft insertion hole and a size of each of said plurality of separate annular grooves varies so that a bending rigidity of said tip end area of said hosel portion can be lowered.

7. A golf club according to claim 6, wherein said plurality of grooves are different from each other in depth.

8. A golf club according to claim 6, wherein said plurality of grooves are different from each other in width.

9. A golf club according to claim 7, wherein said depth of said grooves becomes gradually larger toward a tip end of said hosel portion.

10. A golf club according to claim 8, wherein said width of said grooves becomes gradually smaller toward a tip end of said hosel portion.

11. A golf club according to claim 5, further comprising a non-rigid material provided in said annular grooves.

12. A golf club according to claim 6, further comprising a non-rigid material provided in each of said plurality of grooves.

13. A golf club comprising a shaft and a head attached to one end of said shaft, said head being provided with a hosel portion which has a shaft insertion hole, wherein said hosel portion is spacedly provided with a plurality of separate annular grooves on an outer circumferential surface thereof and a size of each of said plurality of separate annular grooves varies so that a bending rigidity of said tip end area of said hosel portion can be lowered.

14. A golf club comprising according to claim 13, wherein said plurality of annular grooves differ from each other in depth.

15. A golf club according to claim 13, wherein said plurality of annular grooves differ from each other in width.

* * * * *